US009157706B2

(12) United States Patent
Shea

(10) Patent No.: US 9,157,706 B2
(45) Date of Patent: Oct. 13, 2015

(54) SHOOTING RANGE TARGET ASSEMBLY

(71) Applicant: Michael Joseph Shea, Green Bay, WI (US)

(72) Inventor: Michael Joseph Shea, Green Bay, WI (US)

( * ) Notice: Subject to any disclaimer, the term of this patent is extended or adjusted under 35 U.S.C. 154(b) by 313 days.

(21) Appl. No.: 13/798,057

(22) Filed: Mar. 12, 2013

(65) Prior Publication Data

US 2014/0265131 A1 Sep. 18, 2014

(51) Int. Cl.
*F41J 7/02* (2006.01)
*F41J 7/06* (2006.01)

(52) U.S. Cl.
CPC ..... *F41J 7/06* (2013.01); *F41J 7/02* (2013.01)

(58) Field of Classification Search
CPC ..... F41J 7/00; F41J 7/02; F41J 7/04; F41J 7/06
USPC ..... 273/403–410, 390–392, 359
See application file for complete search history.

(56) References Cited

U.S. PATENT DOCUMENTS

| | | | | | |
|---|---|---|---|---|---|
| 1,000,639 | A | * | 8/1911 | Stillman | 273/406 |
| 2,344,829 | A | * | 3/1944 | McAvoy | 104/173.1 |
| 2,793,038 | A | * | 5/1957 | Wallace et al. | 273/369 |
| 3,602,511 | A | * | 8/1971 | Gehmann | 273/406 |
| 3,614,102 | A | * | 10/1971 | Nikoden, Sr. | 273/406 |
| 3,914,879 | A | * | 10/1975 | Taylor et al. | 434/19 |
| 4,072,313 | A | * | 2/1978 | Murso et al. | 273/359 |
| 4,088,322 | A | * | 5/1978 | Nikoden, Jr. | 273/406 |
| 4,288,080 | A | * | 9/1981 | Laporte et al. | 273/406 |
| 4,501,427 | A | | 2/1985 | Payne | |
| 4,889,346 | A | | 12/1989 | Destry et al. | |
| 4,890,847 | A | * | 1/1990 | Cartee et al. | 273/406 |
| 5,163,689 | A | | 11/1992 | Bateman | |
| 5,350,180 | A | | 9/1994 | Acock | |
| 5,605,335 | A | * | 2/1997 | Simpson | 273/406 |
| 5,951,016 | A | | 9/1999 | Bateman | |
| 5,967,522 | A | * | 10/1999 | Corcoran et al. | 273/406 |
| RE38,540 | E | | 6/2004 | Bateman | |
| 6,808,177 | B2 | | 10/2004 | Dehart | |
| 7,052,012 | B2 | | 5/2006 | Dehart | |
| 7,303,192 | B2 | | 12/2007 | Marshall et al. | |
| 7,614,626 | B1 | * | 11/2009 | Aanerud et al. | 273/367 |
| 7,914,004 | B2 | | 3/2011 | Wright et al. | |
| 7,946,588 | B1 | * | 5/2011 | Hockman et al. | 273/406 |
| 7,950,667 | B2 | | 5/2011 | Shum | |
| 8,006,981 | B2 | * | 8/2011 | Gibson | 273/359 |
| 8,016,291 | B2 | | 9/2011 | Wright et al. | |
| 8,074,994 | B1 | * | 12/2011 | Delphia | 273/406 |
| 8,162,319 | B2 | | 4/2012 | Stincelli et al. | |
| 2006/0240388 | A1 | | 10/2006 | Marshall et al. | |
| 2008/0174071 | A1 | | 7/2008 | Potterfield et al. | |

* cited by examiner

*Primary Examiner* — Mark Graham
(74) *Attorney, Agent, or Firm* — Steven H. Greenfield; Greenfield Invention and Patent Consulting, Inc.

(57) ABSTRACT

A shooting range target assembly and a method for moving and positioning the target in a controlled manner are disclosed. The assembly includes a conveyor line containing a carriage, a drive, a target assembly, a turning and positioning mechanism and a programmable logic for setting and controlling the movement of the carriage. Controlling the movement, positioning of the target and maintaining target position are accomplished by properly balancing a torque force applied onto a pulley wheel, a drag force applied by a detent assembly and a force applied by a brake. The assembly is configured for moving the target along the conveyor and turning it such that the front side, the back side or an edge faces the shooter.

9 Claims, 14 Drawing Sheets

SHOOTING RANGE TARGET ASSEMBLY

FIELD OF THE INVENTION

The present invention relates to a shooting range target assembly and a method for moving and positioning a target in a controlled manner. More specifically, the present invention relates to a programmable system for moving and turning a target such as for practicing shooting in an indoor setting.

BACKGROUND OF THE INVENTION

In target shooting practices using handguns, it is often desirable to use a moving target configured for quickly appearing and disappearing. A number of prior art references provide systems for conveying shooting targets to various locations and turning the targets.

U.S. Pat. No. 5,967,522 teaches a target holding and turning assembly which includes a turning motor a target-holding shaft, an outer sleeve and a support bearing collar.

In U.S. Pat. No. 4,501,427 the turning mechanism is operated by a timer that operates a solenoid and a cylinder that retracts a piston rod to turn the target boards.

U.S. Pat. No. 4,889,346 uses a target positioning assembly that allows the target holder to be rotated 360 degrees.

U.S. Pat. No. 5,163,689 is for a target support structure and system which holds and turns a flat target from edge to face and back again. Targets are held and turned at the bottom and are supported at the top by a pivoting connection attached to a stationary bar frame.

U.S. Pat. No. 5,350,180 describes a target system having a plurality of flat target boards mounted on posts which are rotatably journaled on an elongated base. Each post is rotatable ninety degrees. A drive crank arm is pivoted to the base for horizontal swinging movement and is pivotally connected to an elongated drive and synchronizing bar which in turn is pivotally connected to a plurality of lever arms connected to the respective posts to swing the target boards simultaneously between full view positions easily visible to a shooter, and edge view positions not visible to the shooter.

Preferred embodiments of U.S. Pat. No. 5,951,016 are implemented as track-based systems, as the track provides not only stability to the target carrier, but also protection from stray bullets to the conductive cable. For a first embodiment of the invention, power is transferred to a target carrier via a stationary inductor and a movable cable, which also provides motive force to the target carrier. For a second embodiment of the invention, power is transferred to a target carrier via a stationary cable and an inductor movable with the target carrier. For this second embodiment of the invention, electrical equipment on board the target carrier includes a drive motor for moving the carrier bi-directionally along the track. For example, the decoded signals may direct the drive motor to move the carrier forward or backward, or direct a target-pivoting motor to rotate the target to a desired position.

FIG. 5 of U.S. Pat. No. 6,808,177 illustrates a partial perspective view of a turner. In particular, the turner is substantially perpendicular to the shooting direction. Thus, as the turner actuation device is actuated, the turner pivots, on hinge, to a direction substantially traverse to a shooting direction. Alternatively, the turner unit device can be rotated 90 degrees and be removably fixed to the turner mounting receptacle.

FIG. 4 of U.S. Pat. No. 7,052,012 illustrates a side view of an exemplary embodiment of the target system. In particular, the target system has all targets oriented in a direction substantially perpendicular to a shooting direction. Furthermore, FIG. 4 illustrates how the plate rack righting mechanism cooperates with a plate rack righting lever to right one or more plates on the plate rack. Specifically, upon activation, the plate rack righting element interacts with the plate rack righting lever to return one or more plates of the plate rack to the upright position.

The invention in U.S. Pat. No. 7,303,192 uses a drop/turn assembly. The target adapter is formed with a body, a stand, a target shaft and a bullet deflection plate. As described, the shaft is twisted, and may be moved vertically such that the interaction between the twisted shaft and the slot formed in the top plate causes the shaft to rotate. As shown, the shaft has a first twist and a second twist causing the shaft to rotate twice while moving vertically. Accordingly, the bullet target which is mounted to the shaft may be rotated such that it is initially not presented to the shooter, is presented to the shooter for a period of time, and is then moved so as not to be presented to the shooter.

In U.S. Pat. Nos. 7,914,004 and 8,016,291, a target actuator is configured to rotate the drive shaft so that the target may be disposed in three distinct positions.

U.S. Pat. No. 7,950,667 uses target holders connectable to corresponding drive shafts for rotating the targets.

U.S. Pat. No. 8,162,319 describes an omni-directional target system that includes a target movable between a retracted position and an extended position and an actuation mechanism for moving the target to the extended position, the target and the actuation mechanism being releaseable so that the target can be moved back into the retracted position despite movement of the actuation mechanism. No details about the actuation mechanism are provided.

The mechanism for turning the targets in US20060240388 comprises of a plate having an arm and hole for attaching a spring to the base at the hole. The spring urges the plate to rotate in a clockwise direction. The plate is also formed with the lever and the hole to which a cord or cable may be attached. The cord would be used to rotate the plate in a counterclockwise direction and thereby rotate the target.

US20080174071 describes a target connector for rotating and holding the targets in place. The device is different than the device of the present invention.

USRE38540 uses a target-pivoting motor to rotate the target to a desired position.

With many of the the systems disclosed in the prior art, the motor used for moving the target is moved to and is exposed to the line of fire which is a significant drawback since a misdirected shot could damage the motor.

SUMMARY OF THE PRESENT INVENTION

In one aspect of the present invention, an assembly for carrying, conveying, positioning and turning a shooting practice target relative to a stationary shooter situated in an overhead position relative to the shooter and the target being situated at substantially at the shooter eye level comprises: a conveyor line having a front end, a back end, a top side and a bottom side; a carriage disposed on the top side of the conveyor line, the carriage having a top side and a bottom side; a drive system adapted for forward and reverse transporting of the carriage, the drive being powered by a variable speed motor and a timing belt; a target assembly affixed to the carriage, the target assembly containing a target plate having a front side, a rear side, a first side edge, a second edge, a top edge and a bottom edge, the target assembly also containing a shaft, the shaft being attached to a midpoint of the target plate top edge, the target plate being disposed downward from the conveyor at substantially a shooter's eye sight level; a turning and positioning mechanism for the target plate, the mechanism being configured for turning and positioning the target plate in positions of: the target plate front side facing the shooter, the target plate rear side facing the shooter and the target plate first edge facing the shooter; and a programmable logic for controlling and adjusting a moving speed of the carriage, setting a direction of carriage movement, and setting a timing for turning the target plate.

In another aspect of the present invention, a method for conveying and positioning a shooting practice target comprises: providing an assembly adapted for carrying, conveying, positioning and turning a shooting practice target relative to a stationary shooter; conveying the target plate at a conveying speed from a load position to a predetermined distance away from the shooter to a position wherein the front side of the target plate faces the shooter; turning the target plate clockwise 90 degrees relative to a direction of conveying from a position of the front side of the target plate facing the shooter to a position wherein the first side edge of the target faces the shooter; conveying the target plate at a conveying speed having a position of the first side edge facing the shooter a preset distance away from the shooter; and turning the target plate from a position of the first edge facing the shooter to a ready to shoot position.

These and other features, aspects and advantages of the present invention will become better understood with reference to the following drawings, description and claims.

DETAILED DESCRIPTION OF THE INVENTION

Figure 1:
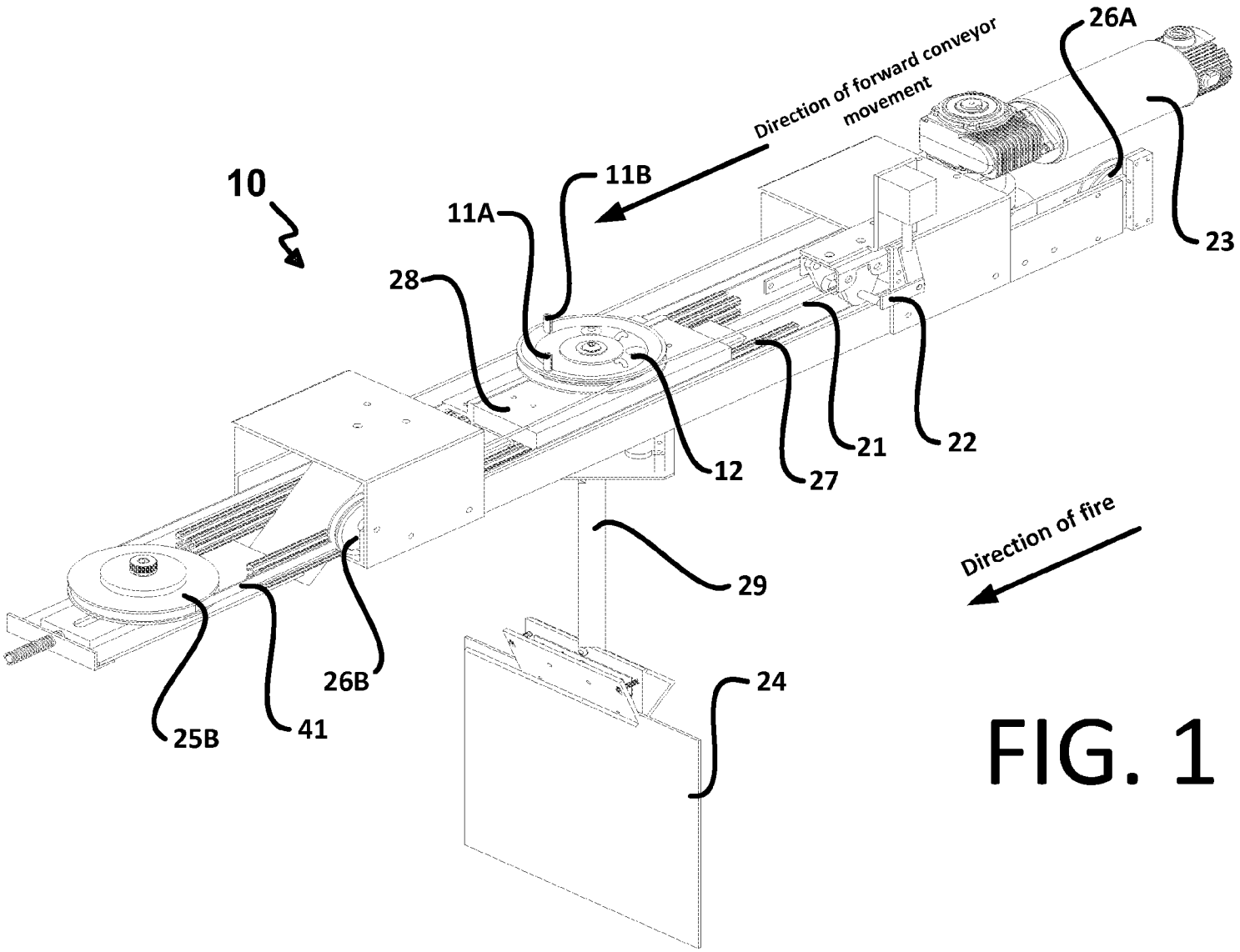
FIG. 1 is a top perspective view of the assembly adapted for carrying, conveying, positioning and turning a shooting practice target according to an embodiment of the present invention.

The following detailed description is of the best currently contemplated modes of carrying out exemplary embodiments of the invention. The description is not to be taken in a limiting sense, but is made merely for the purpose of illustrating the general principles of the invention.

In target shooting practice it is often desirable to provide target displays and movements, such as targets that appear quickly and disappear quickly, in order to challenge the shooter. The present invention generally relates to a target used in an indoor gun range for target shooting practices. The object of the present invention is to provide a target that can move and turn in at least two directions at varying speeds so to challenge the shooter's abilities. It is also the object of the present invention to provide a system and method for transporting and positioning the target in various positions that help challenge the shooter. Specifically, the system and method for transporting and positioning the target is configured to accomplish the following:

a. Move the target on conveyor tracks with the front facing the shooter, referred to as the load position, at a programmed speed from a starting point near the shooting booth in a direction away from the shooter then stopping in a preset position where it is presented to the shooter in a stance ready for firing. The target may be programmed to travel at a low speed or a high speed.

b. Convey the target to a specific location on the conveyor then turning the target to be oriented at 90° to the shooter such that the shooter faces an edge of the target.

c. Move the target positioned 90° to the shooter to a predetermined location on the conveyor then turning the target such that the front side faces the shooter in a stance ready for firing.

d. Move the target oriented 90 degrees to the shooter to a predetermined location on the conveyor then turning the target such that the rear side faces the shooter in a stance ready for tiring.

e. Return the target to its starting point on the conveyor with the target front side facing the shooter.

f. Return the target to its starting point on the conveyor with the target rear side facing the shooter.

g. Turn the target from a position of a 90° orientation to the shooter to the load position and retrieving the target back to its starting position.

The functions of the system for transporting and positioning the target are accomplished by:

a conveyor powered by a motor and driven by a timing belt, a carriage disposed on the conveyor and adapted to move with the conveyor, a target assembly that includes the target and turning mechanism disposed on the carriage, and a programmable logic that controls the speed of the conveyor, the placement of the carriage on the conveyor and the direction of the movement, i.e., forward or reverse for retrieval.

In an embodiment of the present invention, the conveyor transporting the target is about 80 feet long. The conveyor is capable of moving at speeds of about 250 ft/min when moving from one location to another for target positioning. Conveying speed would be typically reduced from about 250 ft/min to a positioning and turning speed of about 75 ft/min.

Figure 2:
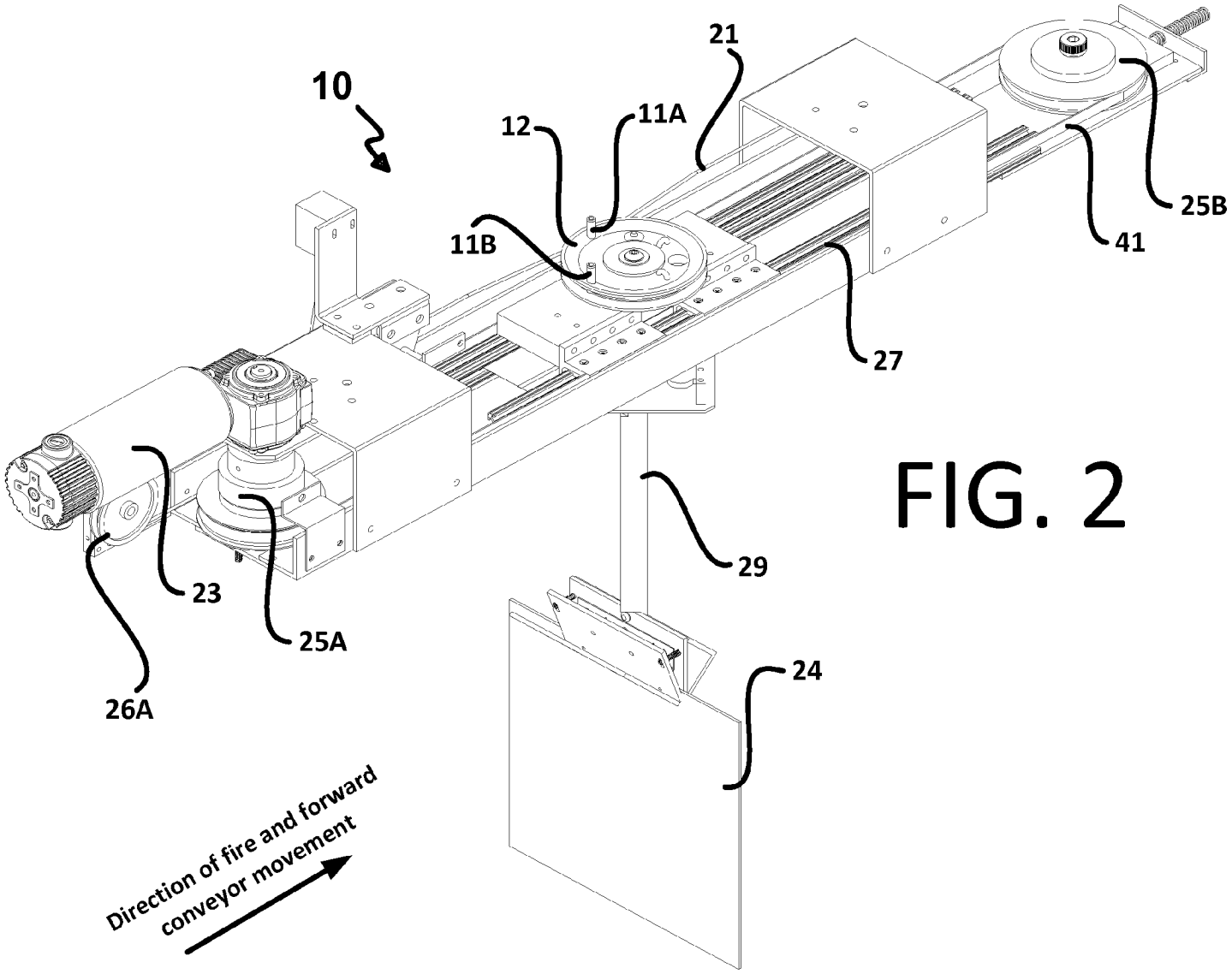
FIG. 2 is another top perspective view of the assembly adapted for carrying, conveying, positioning and turning a shooting practice target according to an embodiment of the present invention.
Figure 3:
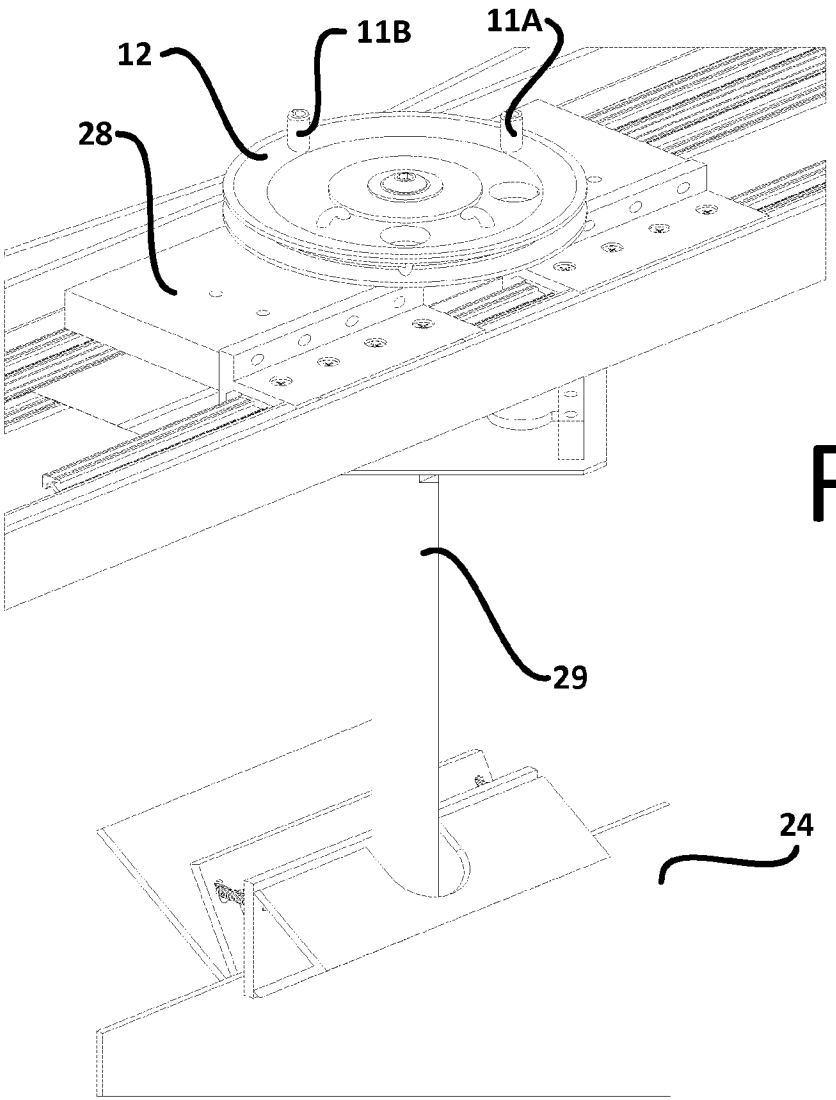
FIG. 3 is a close up view of a component of the assembly turning mechanism according to an embodiment of the present invention.
Figure 4:
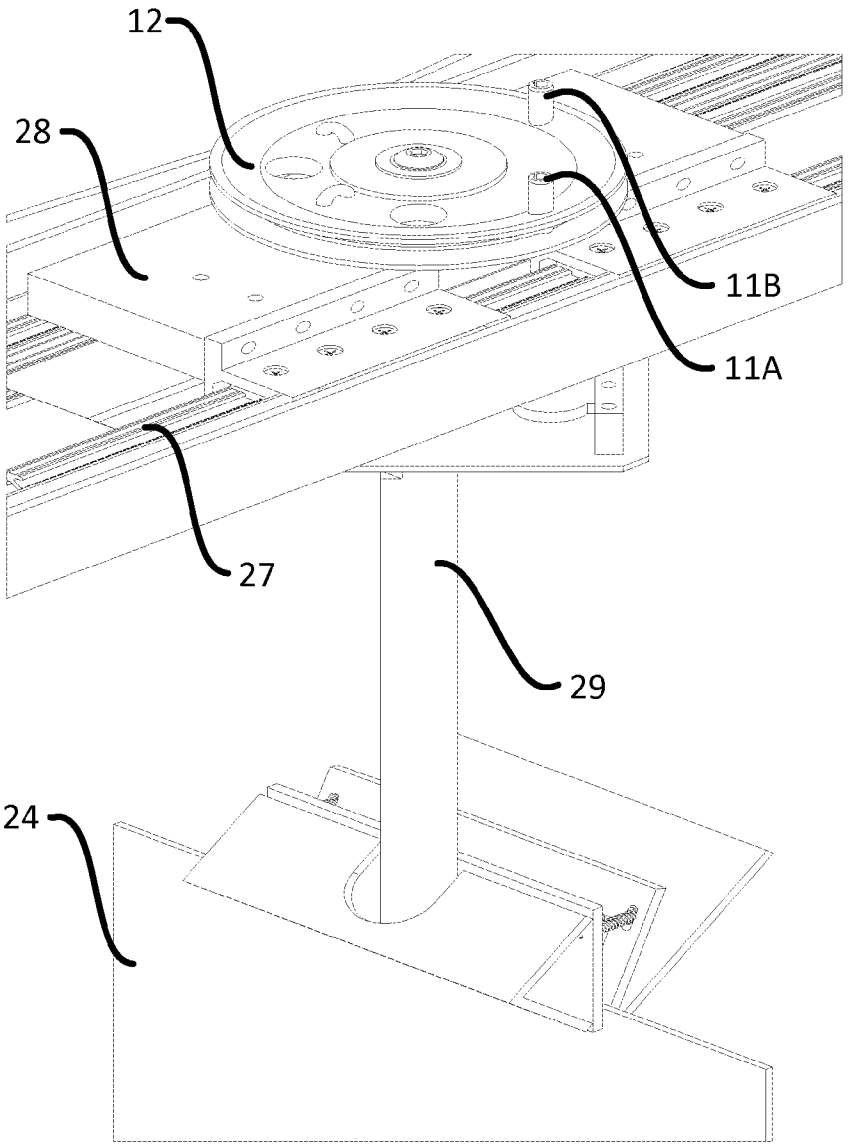
FIG. 4 is another close up view of the component of the assembly turning mechanism of FIG. 3 according to an embodiment of the present invention.
Figure 5:
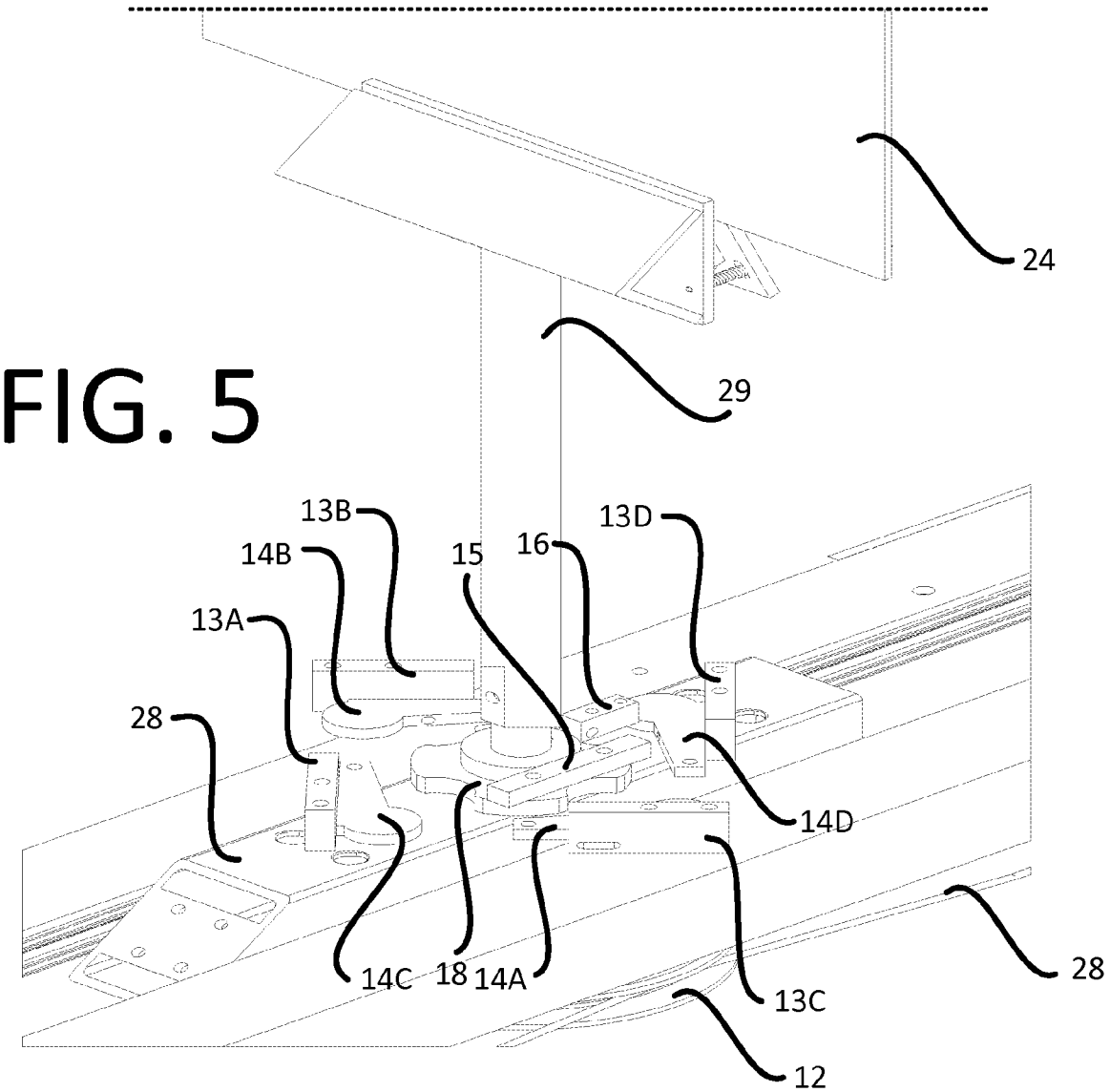
FIG. 5 is a close up view of another component of the turning mechanism according to an embodiment of the present invention.
Figure 6:
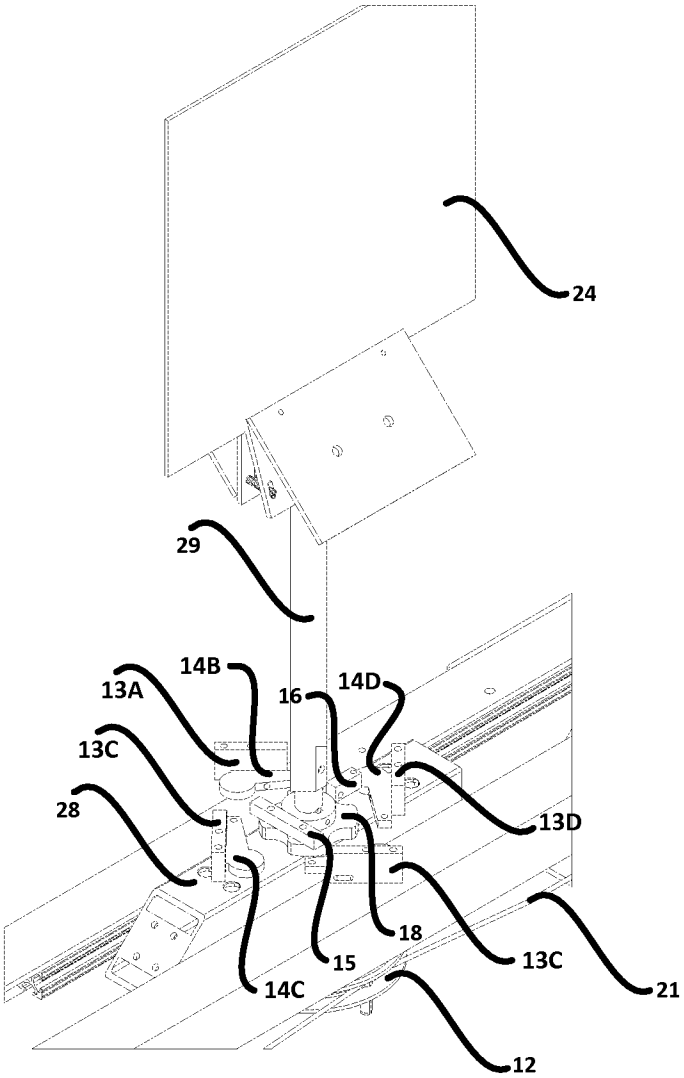
FIG. 6 shows a perspective view of the component of the turning mechanism in FIG. 5 according to an embodiment of the present invention.
Figure 7:
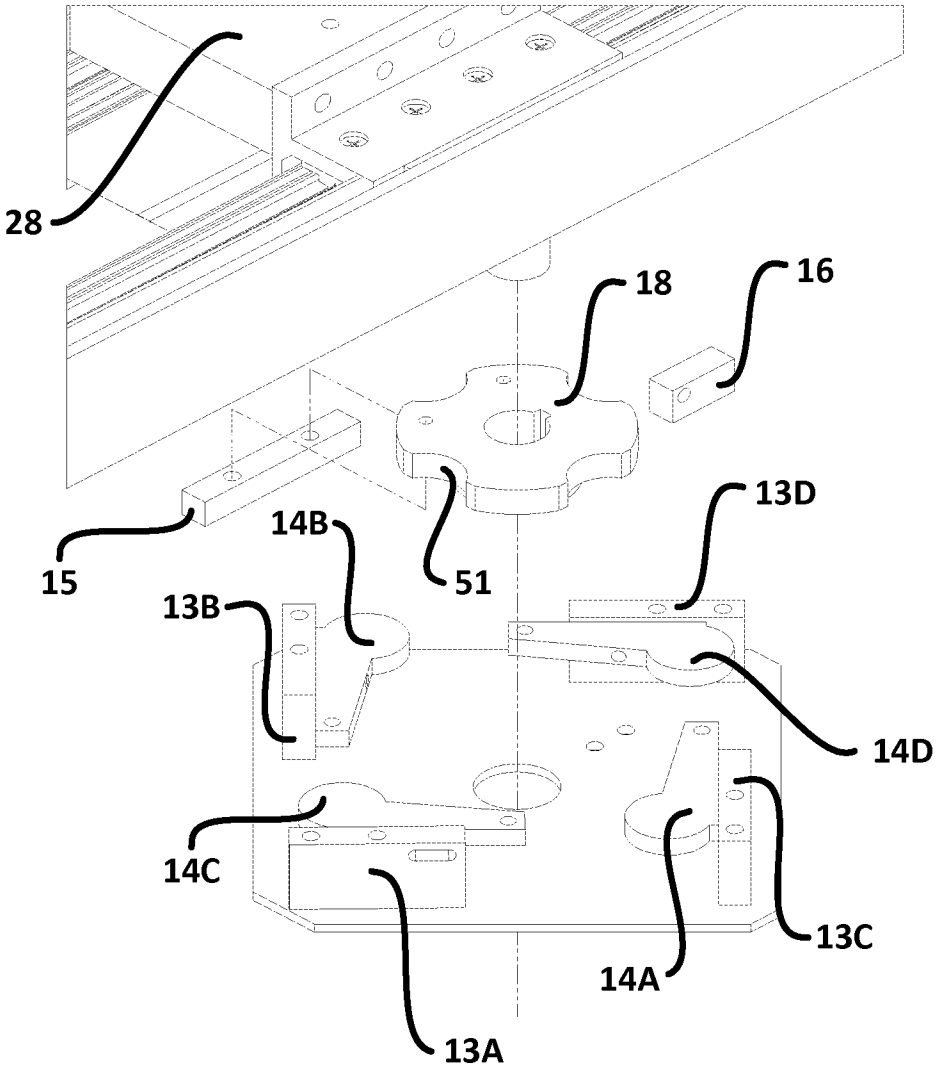
FIG. 7 portrays an exploded view of the component of the turning mechanism in FIG. 5 according to an embodiment of the present invention.
Figure 8:
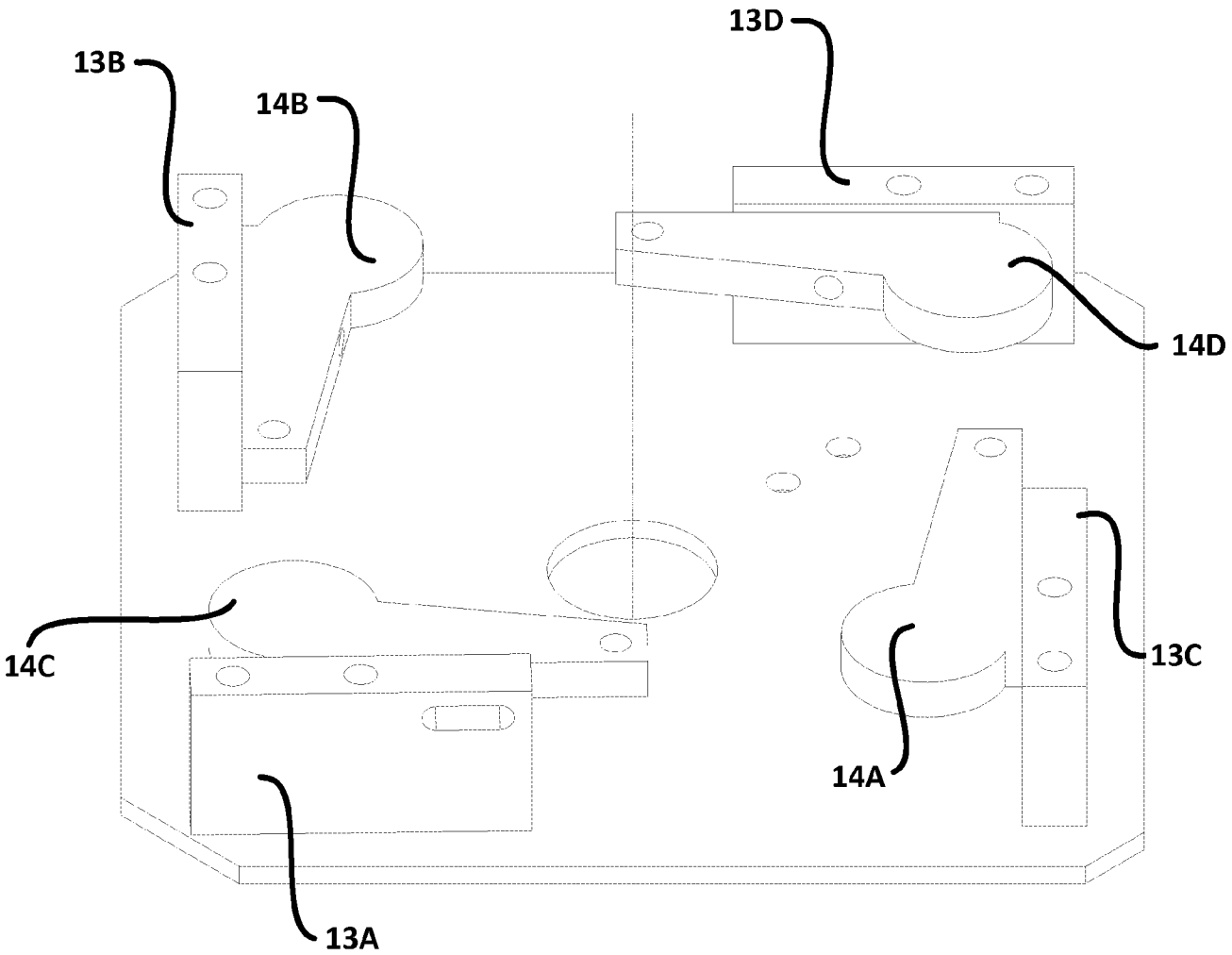
FIG. 8 is a close up depiction of the component of the turning mechanism in FIG. 5 according to an embodiment of the present invention.
Figure 9:
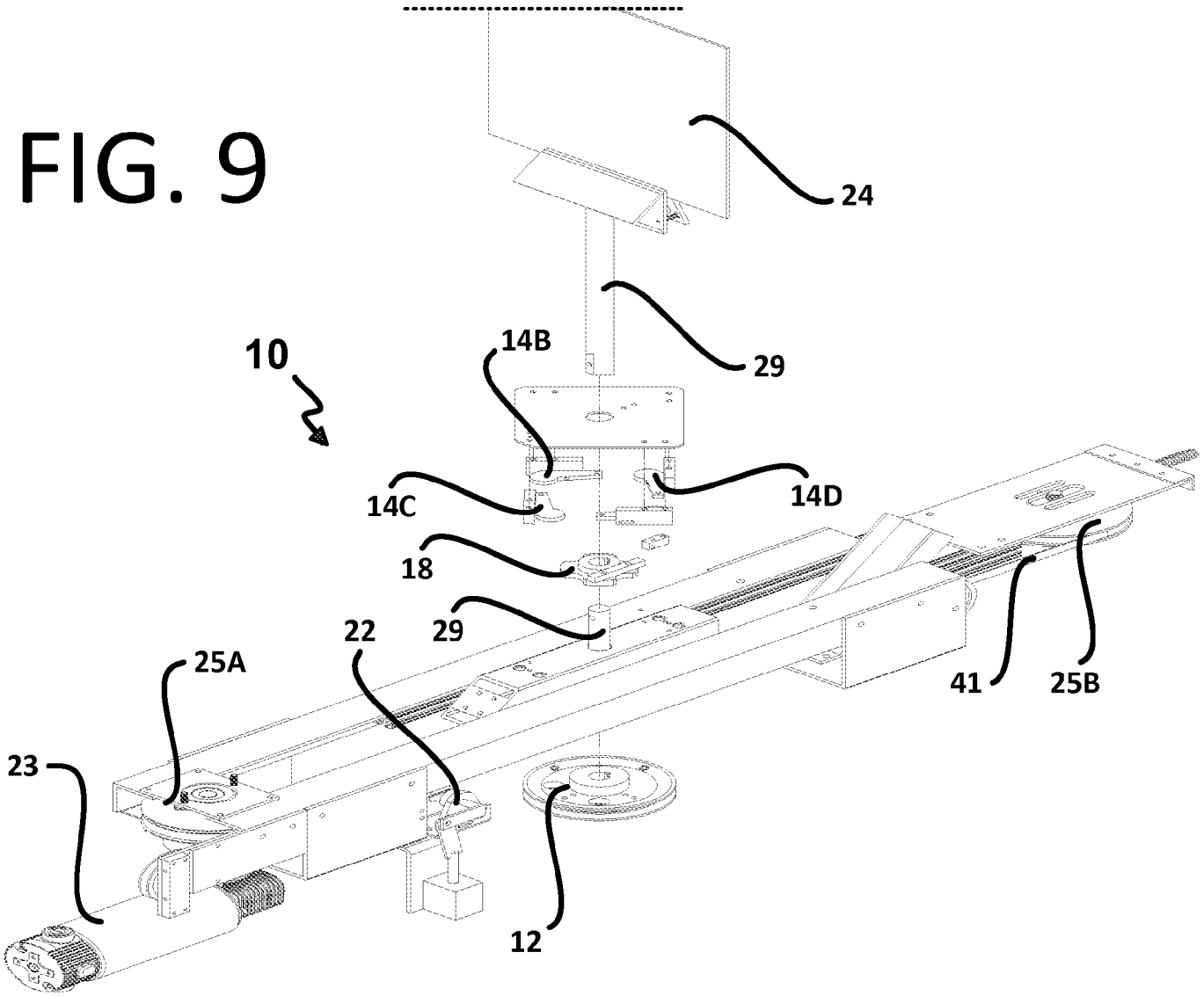
FIG. 9 is an exploded view of the assembly for carrying, conveying, positioning and turning a shooting practice target according to an embodiment of the present invention.
Figure 10:
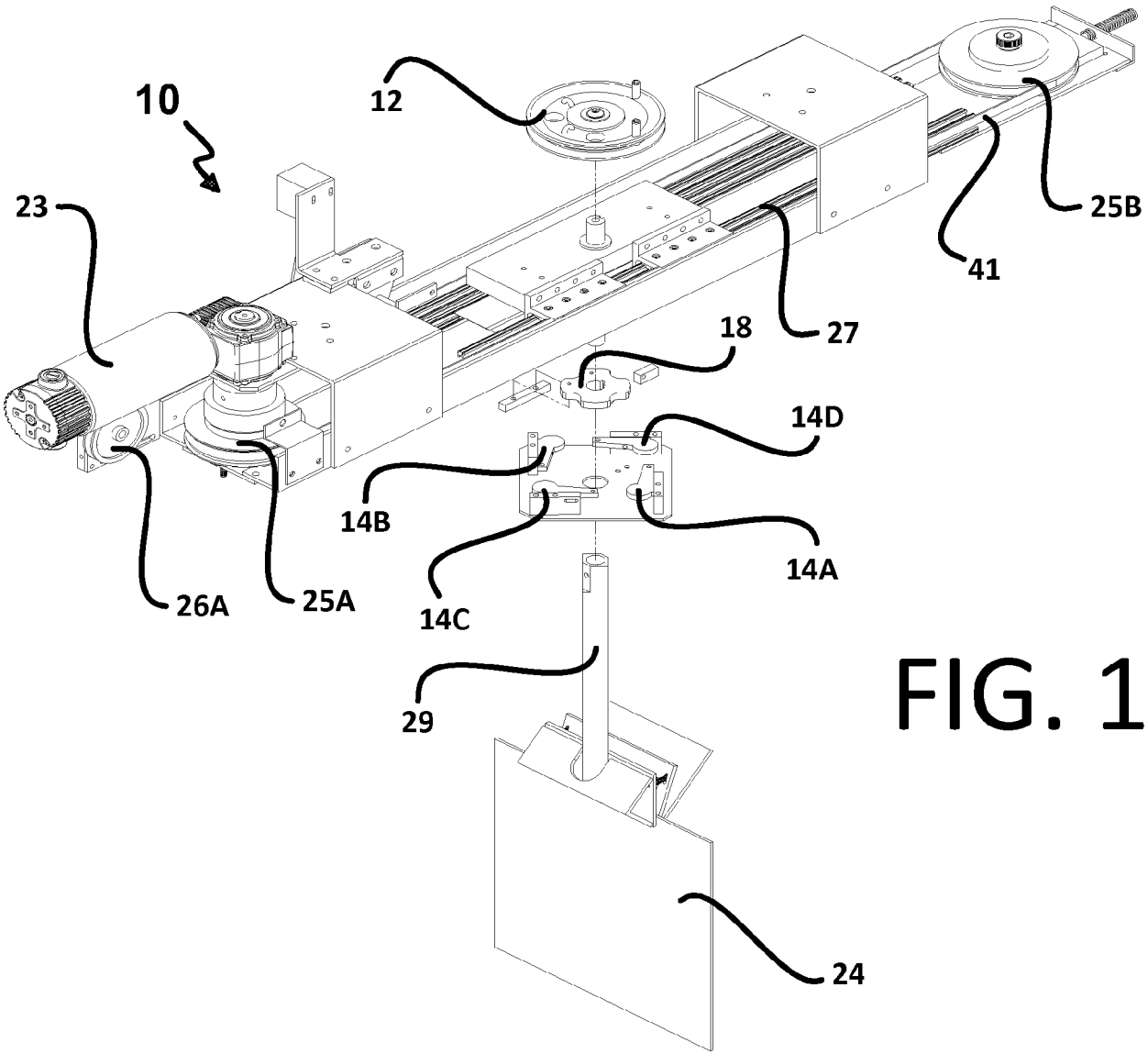
FIG. 10 is another exploded view of the assembly for carrying, conveying, positioning and turning a shooting practice target according to an embodiment of the present invention.
Figure 11:
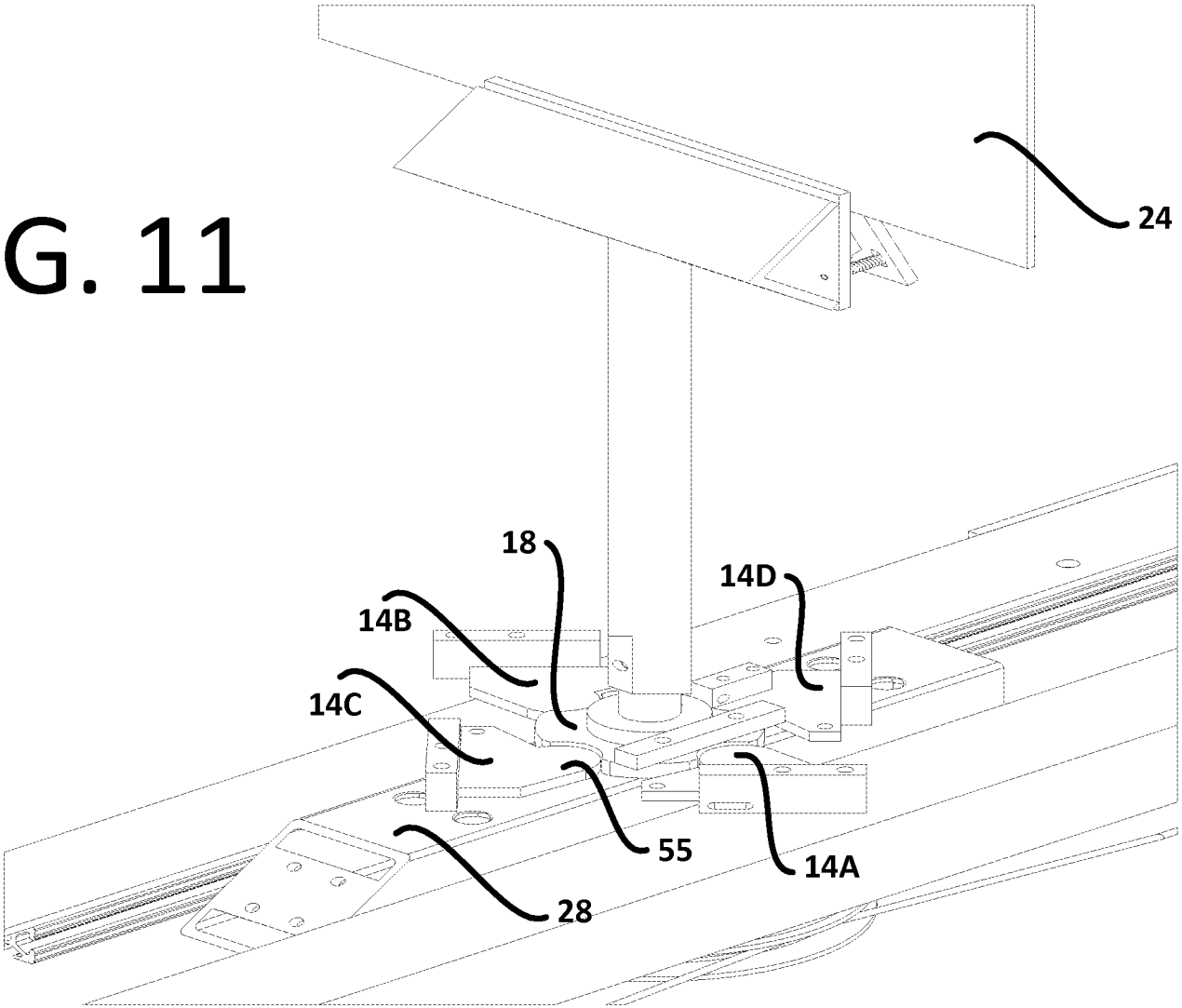
FIG. 11 depicts a close up view of another configuration of the component in FIG. 5 according to an embodiment of the present invention.

The target assembly is illustrated in FIGS. 1-14. A conveyor line 10 contains carriage 28 adapted to travel along railings 27. The conveyor is powered by motor 23 and driven by timing belt 41 wrapped around drive wheels 25A and 25B situated at the two ends of the conveyor 10. The conveyor line 10 is situated in an overhead position relative to the shooter. The target hangs down from conveyor line 10 such that it is situated substantially at the shooter eye level. The shooter is situated in a booth behind the motor 23. The line of fire is indicated by an arrow in FIGS. 1 and 2. A pulley wheel 12 is disposed onto the top side of the carriage 28 and cable 21 wraps around wheels 26A and 26B situated at the two ends of the conveyor 10 and wraps around the pulley wheel 12. A brake 22 is configured to press onto the cable 21. A turning wheel 18 is disposed onto the bottom side of the carriage 28. Shaft 29 threads into a bore permeated through the turning wheel 18, carriage 28 and pulley wheel 12. Target plate 24 having a front side, a back side and four edges on the top, bottom and sides is attached to the shaft 29.

The turning wheel 18 has four recesses 51. Four detents 14A, 14B, 14C and 14B are disposed onto the surface of the carriage 28 having extended tabs 55, each adapted to conform to any of the recesses 51 on the turning wheel 28. The detents are configured in a circle-like arrangement around turning wheel 18. The detents 14 are spring loaded such that a spring loading force is applied onto the detents 14 in the direction of turning wheel 18. Each detent is mounted onto a corresponding mounting block 13A, 13B, 13C or 13D. It is noted that fewer than four detents or more than four detents also fall within the scope of the present invention.

Figure 12:
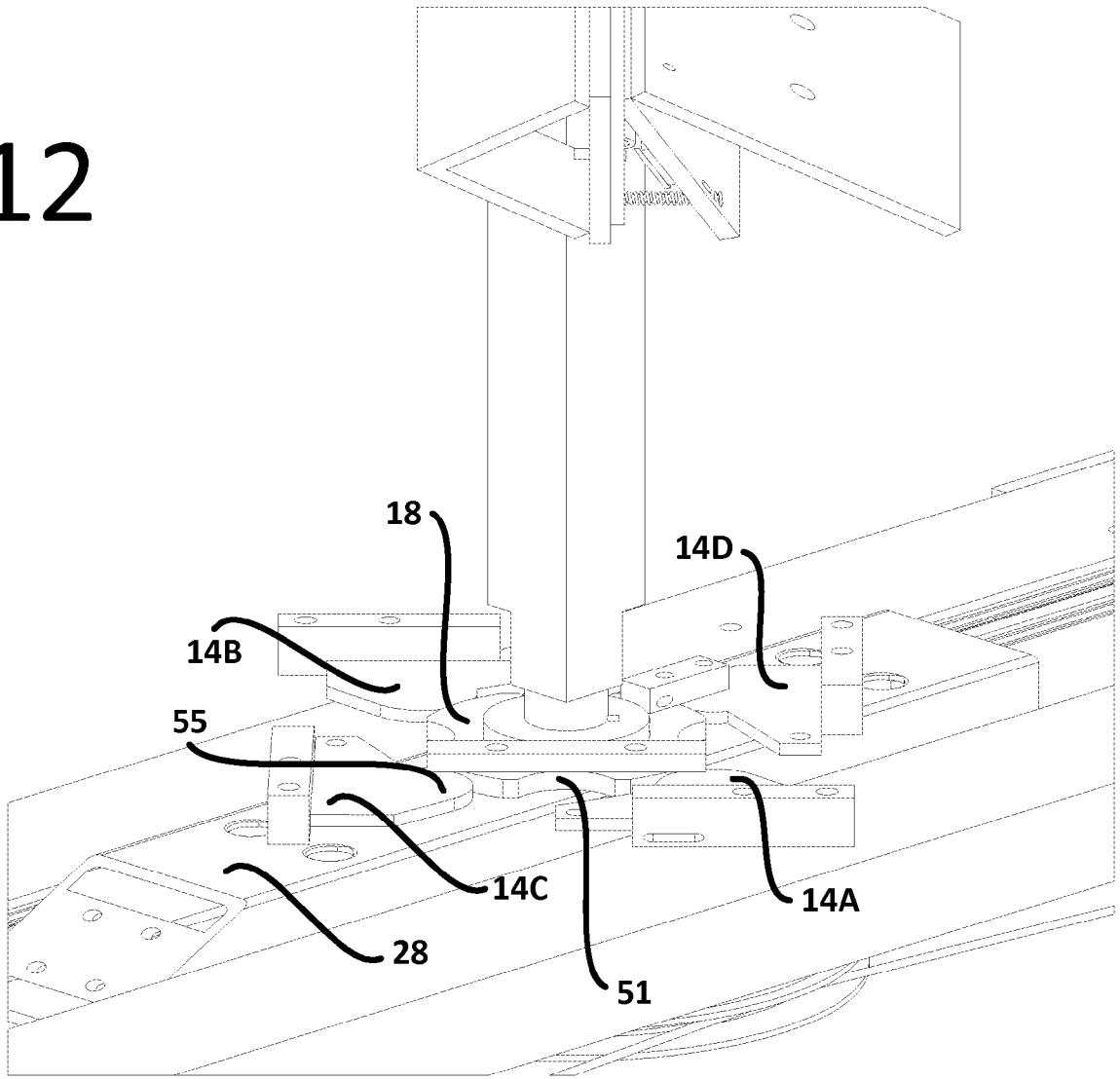
FIG. 12 represents yet another close up view of another configuration of the component in FIG. 5 according to an embodiment of the present invention.

As the carriage 28 is transported from a starting load position further from the shooter, three forces act on the target: 1) the forward force exerted by the drive to move the carriage 28 forward, 2) the friction forces applied by the cable 21 wrapped around the pulley wheel 12 and 3) the drag force applied on the turning wheel 28 by the detents 14. The sum total of these forces produces the movement of the carriage 28 forward with the cable 21 slipping inside the pulley wheel 12. The pulley wheel 12 is prevented from turning by the drag forces exerted by the spring loaded detents 14 thus maintaining the target in position. When it is desired to turn the target, brake 22 is applied to the cable 21 which exerts an additional drag force onto the cable 21. This disturbs the balance of forces on the target. The brake force overcomes the drag force applied by the detents and causes the pulley wheel to turn clockwise such that the target faces the shooter and becomes ready to be fired on. After the target turns 90 degrees, the motor is stopped and the extension tabs on the detents 14 detents slip into the recesses 51 that are in the closest proximity to the detents in that position to keep the pulley wheel 12 and thus the target in place. FIG. 12 illustrates the extension tabs 55 of the detents 14 in contact with the periphery of the turning wheel 18 while the wheel turns. The extension tabs 55 of the detents 14 are placed inside the turning wheel 18 recesses 51 after the wheel turns to keep the wheel from turning further. FIGS. 3, 4, 13 and 14 show the pulley wheel in various configurations with the target oriented facing the shooter and in positions of the target oriented at 90 degrees toward the shooter. FIGS. 5-8, 11 and 12 show the detent configurations related to these positions.

In a typical mode of operation, the target would be transported from a load position, i.e., from a location near the motor and having the front side of the target facing the shooter, a certain distance away from the shooter. The target would then be turned clockwise 90 degrees such that the front edge of the target faces the shooter. The target may then be transported in this position to a preset location further from the shooter and be turned clockwise such that the back side of the target faces the shooter. In this location and position, the target is now ready for use. In an alternate embodiment, the target is turned counterclockwise which is accomplished by reversing the direction of the motor and thus the direction of target movement while the brake is engaged. In this location and position, the target front side faces the shooter and is likewise ready for use. At the end of the shooting session, the target would be retrieved back to the load position by running the motor in reverse with the brake off. It is noted that other combinations of locations and positions for the target may be programmed into the logic and selected by the shooter.

The invention further comprises in one of its embodiments a stop arm 15 attached to the top of the turning wheel 18 and a stop block 16 that is disposed in the carriage 28. The stop arm 15 and stop block 16 prevent the over-rotating of the target.

Figure 13:
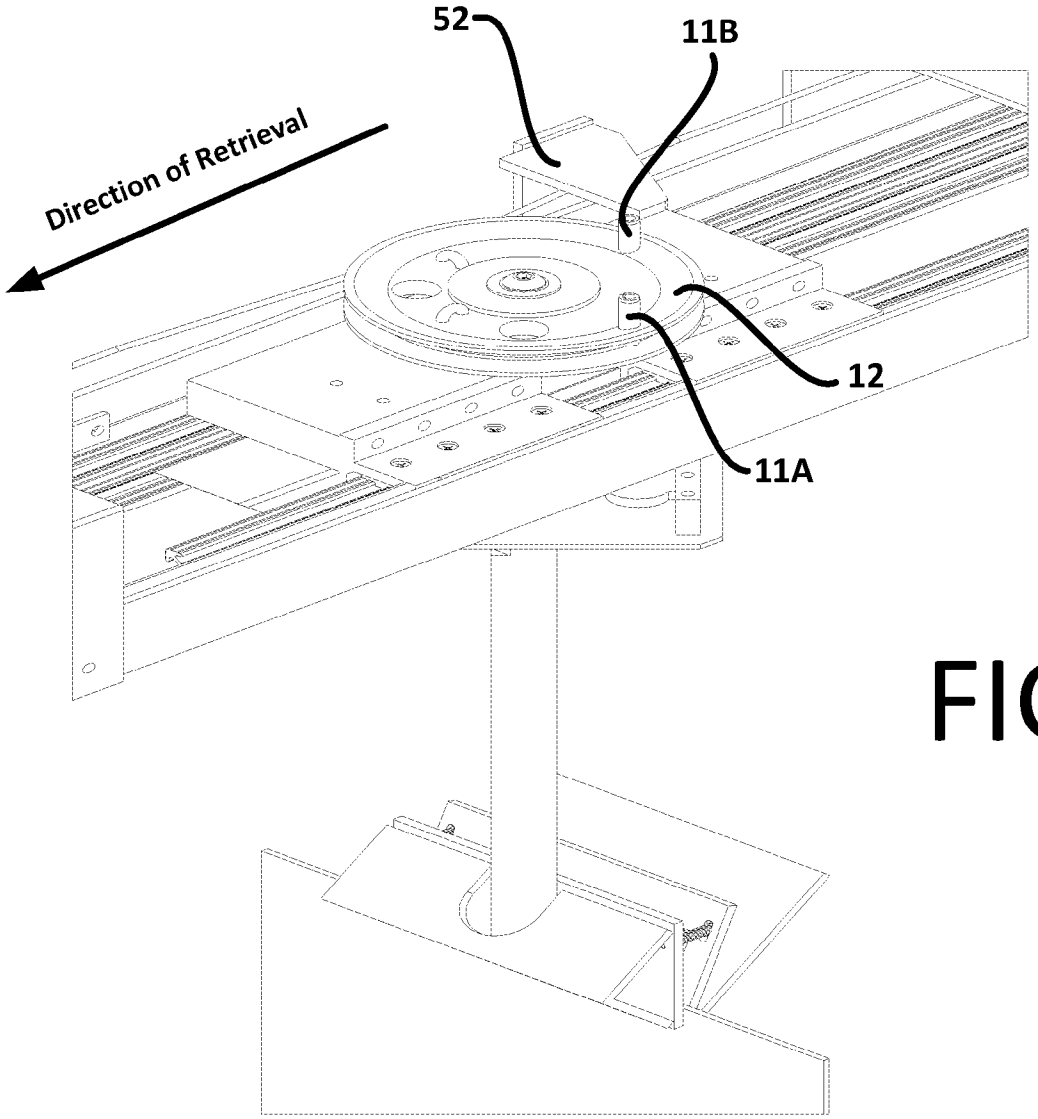
FIG. 13 shows a configuration of another component of the assembly according to an embodiment of the present invention.
Figure 14:
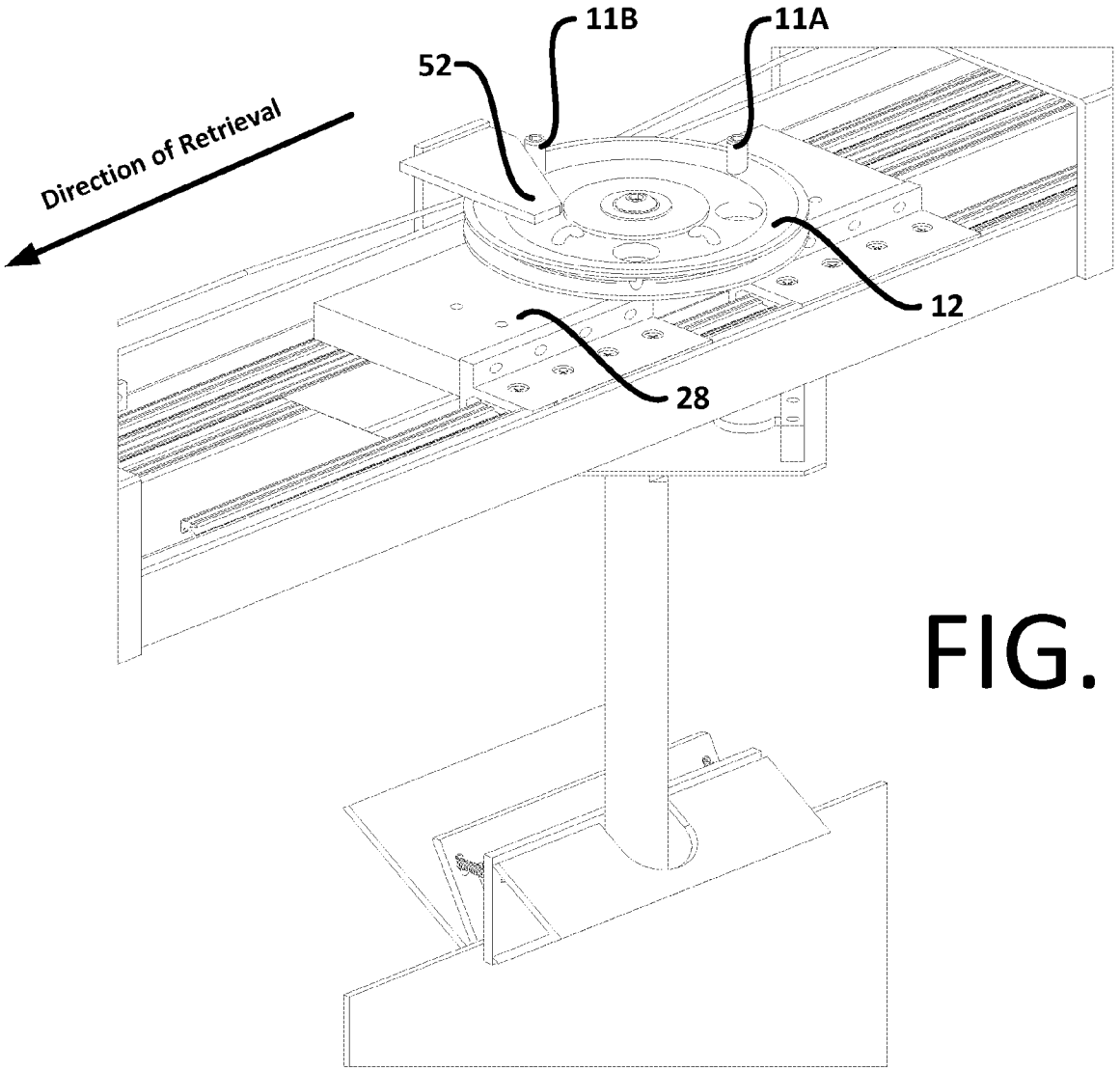
FIG. 14 is another configuration of the component of the assembly shown in FIG. 13 according to an embodiment of the present invention.

At the end of a target practice session, the target is typically returned to the load position for starting another practice sessions. To do so, the target needs to be turned to a position of the front facing the shooter before retrieving the carriage to its starting load position where turning the target is more difficult. If the target is in a position of 90 degrees toward the shooter at the end of the session for any reason, i.e., the shooter is facing the front edge of the target, turning the target counterclockwise such that the front of the target would face the shooter may be accomplished by running the motor in reverse while applying the brake to the cable. The present invention further includes an embodiment of a second fail safe mechanism to ensure that the target turns to a position of the front side facing the shooter prior to the retrieval to a load position. This is accomplished by using stationary turning stop 52 attached to the cable side of the conveyor as shown in FIGS. 13 and 14. Two pins 11A and 11B are attached to the pulley wheel 12 and disposed vertically relative to the wheel. As the target is retrieved, pin 11B is forced against the turning stop 52 which causes the pulley wheel to turn along with the target. The target pre-turn position is illustrated in FIG. 14 while the target post turn position is illustrated in FIG. 13.

It should be understood, of course, that the foregoing relates to exemplary embodiments of the invention and that modifications may be made without departing from the spirit and scope of the invention.

I claim:

1. An assembly adapted for carrying, conveying, positioning and turning a shooting practice target relative to a stationary shooter, said assembly being situated in an overhead position relative to the shooter and the target being situated at substantially at the shooter eye level, said assembly comprising:

a conveyor line having a front end, a back end, a top side and a bottom side;

a carriage disposed on the top side of the conveyor line, said carriage having a top side and a bottom side;

a drive system adapted for forward and reverse transporting of the carriage;

a target assembly affixed to the carriage, said target assembly containing a target plate having a front side, a rear side, a first side edge, a second edge, a top edge and a bottom edge, said target assembly also containing a shaft, said shaft being attached to a midpoint of the target plate top edge, said shaft being held in place by the carriage, said target plate being disposed downward from the conveyor at substantially a shooter's eye sight level;

a turning and positioning mechanism for the target plate, said mechanism being configured for turning and positioning the target plate in positions of: the target plate front side facing the shooter, the target plate rear side facing the shooter and the target plate first edge facing the shooter, said turning and positioning mechanism for the target plate comprising a pulley wheel disposed onto the top side of the carriage; a mechanism for applying a torque force onto the pulley wheel in a direction of turning the pulley wheel; a mechanism adapted for applying a drag force onto the pulley wheel in such a way as to negate the torque force applied onto the pulley wheel, said drag force preventing the pulley wheel from turning while the carriage is in motion; a brake mechanism configured for applying a force onto the pulley wheel in such a manner as a forward force applied by the drive system forces the turning of the pulley 90 degrees in a clockwise direction relative to a direction of motion; and a mechanism for maintaining the target plate in place after turning; and a programmable logic for controlling and adjusting a moving speed of the carriage, setting a direction of carriage movement, and setting a timing for turning the target plate.

2. The assembly of claim 1 wherein the mechanism for applying the torque force onto the pulley wheel comprises a cable wrapped around the pulley wheel, said cable also being wrapped around a first wheel situated at the front end of the conveyor and a second wheel situated at the rear end of the conveyor.

3. The assembly of claim 1 wherein the mechanism for applying a drag force onto the pulley wheel comprises:

a turning wheel disposed on the bottom side of the carriage, said turning wheel comprising four recesses; and one or more spring loaded detents disposed onto the bottom of the carriage, said detents having extension tabs, wherein each extension tab is adapted for conforming into a corresponding recess on the turning wheel, said spring loaded detents being configured to applying a drag force onto the turning wheel to help maintain the target plate in place before and after turning;

said shaft being held in a bore permeated through the pulley wheel, the carriage and the turning wheel.

4. The assembly of claim 3 wherein the extension tabs of the spring loaded detents being positioned inside the detents' respective recesses provide the mechanism for maintaining the target plate in place after turning.

5. The assembly of claim 3, further comprising a stop arm attached to a top side of the turning wheel and a stop block disposed in the carriage, said stop arm and stop block being configured to prevent over-rotating of the target.

6. The assembly of claim 1 further comprising a safety mechanism for turning the target plate from the position of the target plate first edge facing the shooter to the position of the target plate front side facing the shooter when the target plate is retrieved.

7. The assembly of claim 6, wherein the mechanism for turning the target plate from the position of the target plate first edge facing the shooter to the position of the target plate front side facing the shooter comprises two vertical pins attached to the pulley wheel and a stationary stop configured for blocking the pins and forcing the pulley wheel to turn clockwise relative to a direction of motion.

8. The assembly of claim 3 wherein a number of spring loaded detents is three.

9. The assembly of claim 3 wherein a number of spring loaded detents is four.

* * * * *